US006911614B2

(12) United States Patent
Asano et al.

(10) Patent No.: US 6,911,614 B2
(45) Date of Patent: Jun. 28, 2005

(54) CIRCUIT BREAKER

(75) Inventors: Hisanobu Asano, Saitama (JP); Mitsuhiro Mitsushige, Saitama (JP); Hideto Yamagata, Saitama (JP); Yasuhiro Takahashi, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 10/691,673

(22) Filed: Oct. 24, 2003

(65) Prior Publication Data

US 2004/0124074 A1 Jul. 1, 2004

(30) Foreign Application Priority Data

Oct. 28, 2002 (JP) ..... 2002-312629

(51) Int. Cl.[7] ..... H01H 23/00; H01H 3/00; H01H 71/10

(52) U.S. Cl. ..... 200/401; 200/DIG. 42; 335/191; 337/70

(58) Field of Search ..... 200/400, 401, 200/402–472, 318–327, DIG. 42; 335/185, 189, 191; 337/6, 7, 57–59, 70, 72

(56) References Cited

U.S. PATENT DOCUMENTS 3,605,051 A * 9/1971 Casey et al. ..... 335/166
3,849,751 A * 11/1974 Link et al. ..... 337/59
4,679,016 A * 7/1987 Ciarcia et al. ..... 335/132
5,296,664 A * 3/1994 Crookston et al. ..... 200/401

FOREIGN PATENT DOCUMENTS

JP 5-182577 7/1993

* cited by examiner

*Primary Examiner*—James R. Scott
(74) *Attorney, Agent, or Firm*—Manabu Kanesaka

(57) ABSTRACT

A circuit breaker includes a fixed contact; a movable contact disposed in a rotary-type contact holder; a switching device; an operation handle; and an over-current tripping device. The operation handle is operated to open and close main-circuit contact points through the switching device. The switching device includes a handle lever connected to the operation handle; a toggle linkage having an upper toggle link and a lower toggle link; a switching spring placed between the handle lever and an arm connecting point of the toggle linkage; and a side plate for holding the components. The circuit breaker further includes a device for preventing the operation handle from moving to an off position when the contact points are stuck together. The device includes first stoppers formed on a cross bar of the contact holder and the handle lever facing the cross bar, and a second stopper formed on the side plate.

3 Claims, 7 Drawing Sheets

CIRCUIT BREAKER

BACKGROUND OF THE INVENTION AND RELATED ART STATEMENT

The present invention relates to a circuit breaker used for a circuit breaker of a low-voltage circuit, a ground leakage interrupter, and the like. More specifically, the present invention relates to a switching device provided in a circuit breaker and having an isolation function for preventing an operation handle from moving to an off position when main-circuit contact points are stuck together due to an abnormal current.

A basic configuration of a circuit breaker to which the present invention is applied is shown in FIG. 6. In FIG. 6, reference numeral 1 denotes a case (resin case) of a circuit breaker; reference numeral 2 denotes a main-circuit terminal on a power-source side; reference numeral 3 denotes a main-circuit terminal on a load side; reference numeral 4 denotes a fixed contact; reference numeral 5 denotes a movable contact; reference numeral 6 denotes a circuit interrupter; reference numeral 7 denotes a contact holder of the movable contact 5; reference numeral 8 denotes a switching device; reference numeral 9 denotes an operation handle; and reference numeral 10 denotes a bimetal-type over-current tripping device.

The switching device 8 has a side plate (assembly frame of the switching device) 17. The side plate 17 supports a swing-type handle lever 11 connected to the operation handle 9; a toggle linkage 12 having an upper toggle link 12*a* and a lower toggle link 12*b* connected with a connecting pin 12*c* and bridging the contact holder 7 of the movable contact 5 and a latch (trip lever) 13 through pin connection; a latch receipt 15 combined with a trip cross bar 14 for locking the latch 13 in a normal state and for releasing the latch 13 in response to a movement of the over-current tripping device 10; and a switching spring (tension coil spring) 16 placed between a base (upper side) of the handle lever 11 and the connecting pin 12*c* of the toggle linkage 12.

An operation of switching the circuit breaker is commonly known. When the handle 9 is moved from an "on" position to an "off" position, the switching spring 16 passes over a dead point and is reversed. Accordingly, the upper toggle link 12*a* and the lower toggle link 12*b* of the toggle linkage 12 are folded into a shape of the symbol "<" with a spring force of the switching spring 16 to open the movable contact 5.

When an over-current flows during electrification and the over-current tripping device 10 is activated, the latch 13 is released via the trip cross bar 14 from a state that the latch 13 engages the latch receipt 15. As a result, the movable contact 5 is opened by the spring force of the switching spring 16 to shut down the current (tripping). When the tripping occurs, the operation handle 9 moves to an intermediate position between the "on" position and the "off" position together with the handle lever 11 to indicate the tripping. When the circuit breaker is turned on again after the tripping, the handle 9 is moved to the "off" position, i.e. a reset position, to engage the latch 13 with the latch receipt 15. Then, the handle 9 is moved back to the "on" position to close the movable contact 5.

In the circuit breaker described above, the fixed contact and the movable contact may be stuck together when an abnormal current flows through the main circuit in an electrification state in which the main-circuit contact points are closed. In this case, even through the over-current tripping device 10 is operated normally, the movable contact 5 is not opened, and the operation handle 9 remains at the "on" position.

In the switching device described above, it is possible to move the handle 9 from the "on" position to the "off" position by applying a large force thereto, even when the main-circuit contact points are stuck together. Therefore, when the contact points are stuck together, an operator can move the handle to the "off" position and lock the handle with a padlock or the like without knowing the occurrence of the abnormal event. In this case, the operator may touch a hot line and suffer an electric shock, if the operator mistakenly confirms that the breaker is turned off and performs a check and maintenance of the circuit on the load side.

Moreover, the operation handle 9 of the circuit breaker may be provided with an external operation handle device driven by a motor, so that the operation handle 9 can be switched through remote control. In this case, when the operation handle 9 is moved to the "off" position, the external operation handle device sends a breaker-off signal and locks the operation handle 9 in the "off" position. For this reason, if an abnormal current flows and the contact points are stuck, the operator mistakenly confirms that the breaker is turned off, thereby causing a safety issue.

As a countermeasure against such a problem, a configuration is known in which the circuit breaker is provided with an isolation function for preventing the handle from moving to the "off" position when the contact points are stuck together during the electrification. In a specific configuration, the contact holder 7 of the movable contact 5 and the handle lever 11 are provided with abutting stoppers having protrusion shapes, respectively. With this configuration, when the operator intends to move the operation handle 9 to the "off" position in a state that the contact points are stuck together, the abutting stoppers abut against each other to prevent the handle from moving to the "off" position (refer to Japanese Patent Publication (Kokai) No. 05-182577).

A conventional switching device having such a mechanism is shown in FIG. 7. In FIG. 7, the operation handle 9 is moved to a dead-point position (described later) from the "on" position, in a state that a contact point 4*a* of the fixed contact 4 and a contact point 5*a* of the movable contact 5 are stuck together. In the switching device shown in FIG. 7, an abutting stopper 11*a* protruding toward the contact holder 7 is formed at an end of the handle lever 11, i.e. a position shifted to the right side from a rotational center 0 (on the "off" position side of the operation handle 9). An abutting stopper 7*b* facing the abutting stopper 11*a* is formed on a peripheral surface of the cross bar 7*a* of the contact holder 7 (a rotary shaft of the holder).

The handle lever 11 is formed in a branched shape having an upper base connected to the operation handle 9. A concave groove is formed at an end of the handle lever for receiving a bearing part 17*a* having an L-shape protrusion and formed in an outer surface of the side plate 17, so that the handle lever 11 is rotatably supported. The switching spring (tension spring) 16 holds the handle lever 11 at an assembled position. In general, the handle lever 11 adopts such a support structure in consideration of ease of assembly of the switching device.

"ON" and "OFF" shown in FIG. 7 denote an "on" position and "off" position of the operation handle 9 relative to a reference line (an projected line on the swing fulcrum of the handle lever 11), respectively. Further, "DP" denotes a dead point at which the operation handle 9 transits from the "on" position to the "off" position (a state in which the switching spring 16 is in a neutral position relative to the toggle linkage 12). Furthermore, "SL" denotes an action line of the spring 16 placed between the connecting pin 12*c* of the toggle linkage 12 and an upper side of the handle lever 11. As shown in FIG. 7, the action line "SL" is on the dead point of the toggle linkage 12 (on a line between the connecting pin 12*c* of the toggle linkage 12 and a connecting pin 12*d* of the latch 13 of the upper toggle link 12*a*).

In the structure described above, in the state that the contact points are stuck, when the operator attempts to move the operation handle 9 from the "on" position to the "off" position, the abutting stopper 11*a* of the handle lever 11 abuts against the abutting stopper 7*b* of the contact holder 7 situated at the closed position of the contacts at a point that the operation handle 9 is slightly beyond the dead point DP of the handle, so that the operation handle 9 is prevented from moving to the "off" position.

In the conventional structure shown in FIG. 7, there are the following problems concerning an operation of the isolation function.

As shown in FIG. 7, the concave groove formed at the end of the handle lever 11 receives the bearing part 17*a* formed on the outer surface of the side plate 17 to rotatably support the handle lever 11. In this structure, the abutting stopper 11*a* of the handle lever 11 abuts against the abutting stopper 7*b* of the contact holder 7, thereby preventing the operation handle 9 from moving to the "off" position. In this state, when the operator intends to further move the operation handle 9 by applying a large force thereon, the concave groove at the end of the handle lever 11 moves upwardly out of the bearing part 17*a*. Accordingly, the operation handle 9 moves to the "off" position around the abutting point of the abutting stoppers 11*a* and 7*b*.

In the configuration described above, when the operation handle 9 moves to the "off" position, the abutting stoppers 7*b*, 11*a* abut against each other after the action line of the switching spring 16 passes the dead point DP shown in FIG. 7, so that the abutting stoppers 7*b*, 11*a* do not interfere with each other in the normal "on" and "off" operations. Further, in the state that the contact points are stuck, when the operator releases the operation handle 9 at a position in which the abutting stoppers 7*b*, 11*a* abut against each other to prevent the operation handle 9 from moving, the operation handle 9 returns to the "on" position.

There may be a case that the "off" position of the operation handle 9 is situated close to the DP position depending on an assembly structure of the switching device or due to a play between components. In such a case, when the operation handle 9 is moved toward the "off" position in the state that the contact points are stuck, the handle 9 may easily return to the "off" position from the DP position before the handle 9 is securely prevented from moving.

The operation handle 9 may be locked at the "off" position with a padlock, or the operation handle 9 may be provided with an external operation handle device. In such a case, when the operation handle 9 is moved toward the "off" position in the state that the contact points are stuck, the handle 9 is locked at the "off" position even though the main circuit points are closed, so that the operator mistakenly confirms that the contact points are opened.

In view of the problems described above, the present invention has been made, and an object of the invention is to provide a circuit breaker having an improved configuration relative to the conventional device. In the circuit breaker of the invention, it is possible to securely prevent the operation handle from moving to the "off" position even though the contact points are stuck. Also, it is possible to stabilize the isolation function of the circuit breaker.

Further objects and advantages of the invention will be apparent from the following description of the invention.

SUMMARY OF THE INVENTION

In order to achieve the objects described above, according to the present invention, a circuit breaker includes a fixed contact; a movable contact disposed in a rotary-type contact holder; a switching device; an operation handle; and an over-current tripping device. The operation handle is operated to open and close main-circuit contact points through the switching device. The switching device includes a handle lever connected to the operation handle and having an end portion as a rotational center thereof; a toggle linkage having an upper toggle link and a lower toggle link and disposed between the contact holder and a latch of a tripping mechanism; a switching spring placed between the handle lever and a connecting pin of the toggle linkage; and a side plate for holding the components. The circuit breaker further includes means for preventing the operation handle from moving from an "on" position to an "off" position when the main-circuit contact points are stuck. The means includes abutting stoppers or first stoppers formed on a cross bar of the contact holder and the handle lever facing the cross bar, respectively; and a second stopper for preventing the handle lever from moving around an abutting point of the abutting stoppers to the "off" position.

According to the present invention, the second stopper is a protrusion formed on the side plate, and faces an edge surface of a circular arc member formed on a rear edge of the handle lever around the rotational center of the handle lever.

In the present invention, during a process of moving the operation handle from the "on" position to the "off" position in a state that the contact points are stuck, when the handle lever is forced to move to the "off" position with an additional force from a position where the abutting stoppers abut against each other, the handle lever abuts against the second stopper and engages the same. Accordingly, the handle lever does not come out from a bearing part of the side plate around the abutting point of the abutting stoppers, thereby securely preventing the operation handle from moving to the "off" position.

According to the present invention, the circuit breaker further includes a dog extending from a front edge of a base of the handle lever toward the toggle linkage and a dog-receiving member facing the dog and extending upwardly from the lower toggle link of the toggle linkage. When the handle lever is moved from the "on" position to the "off" position, the dog pushes the dog-receiving member of the lower toggle link so that the dead point of the switching device is shifted to a position closer to the "on" position of the operation handle. Accordingly, even in a case in which the "off" position of the operation handle is positioned close to the DP position of the handle, the circuit breaker can perform the isolation function stably.

In the present invention, when the operation handle is moved from the "on" position to the "off" position, the dog of the handle lever abuts against the dog-receiving member of the lower toggle link of the toggle linkage, and pushes the dog-receiving member to move a connecting point between the lower toggle link and the upper toggle link. Accordingly, the toggle linkage is folded into a shape of the symbol "<", so that the DP position of the toggle linkage relative to an action line of the switching spring is forcibly moved to a position closer to the "on" position of the operation handle. When the contact points are stuck, the action line of the switching spring moves beyond the dead-point position before the operation handle is moved to a position close to the "off" position, and the abutting stoppers abut against each other afterward. Therefore, it is possible to securely prevent the operation handle from moving to the "off" position.

DETAILED DESCRIPTION OF PREFERRED EMBODIMENTS

Figure 1:
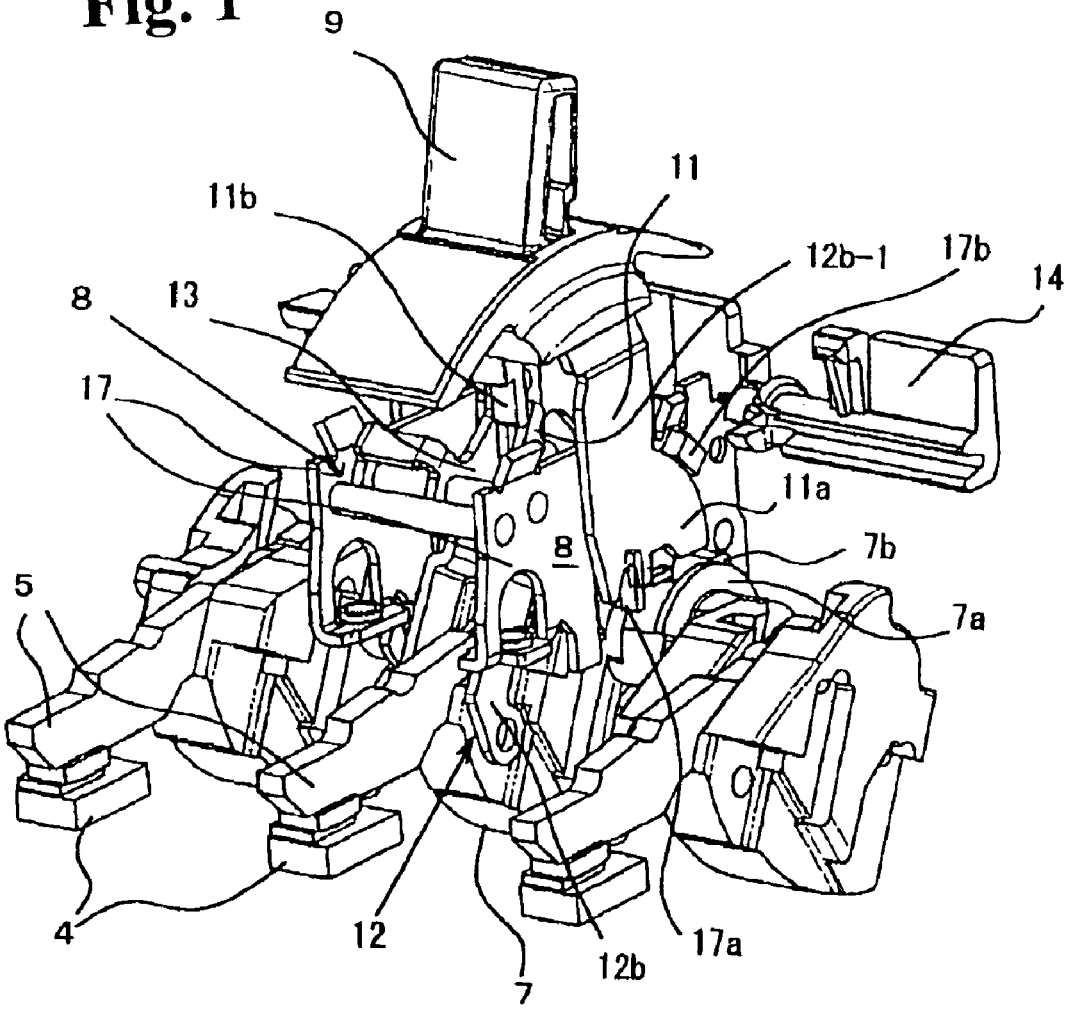
FIG. 1 is a perspective view of a switching device of a circuit breaker according to an embodiment of the invention.

Hereunder, embodiments of the invention will be described with reference to the accompanying drawings. Note that components in FIGS. 1 to 5 corresponding to those shown in FIG. 7 are designated with the same reference numerals, respectively, and descriptions thereof are omitted.

Figure 7:
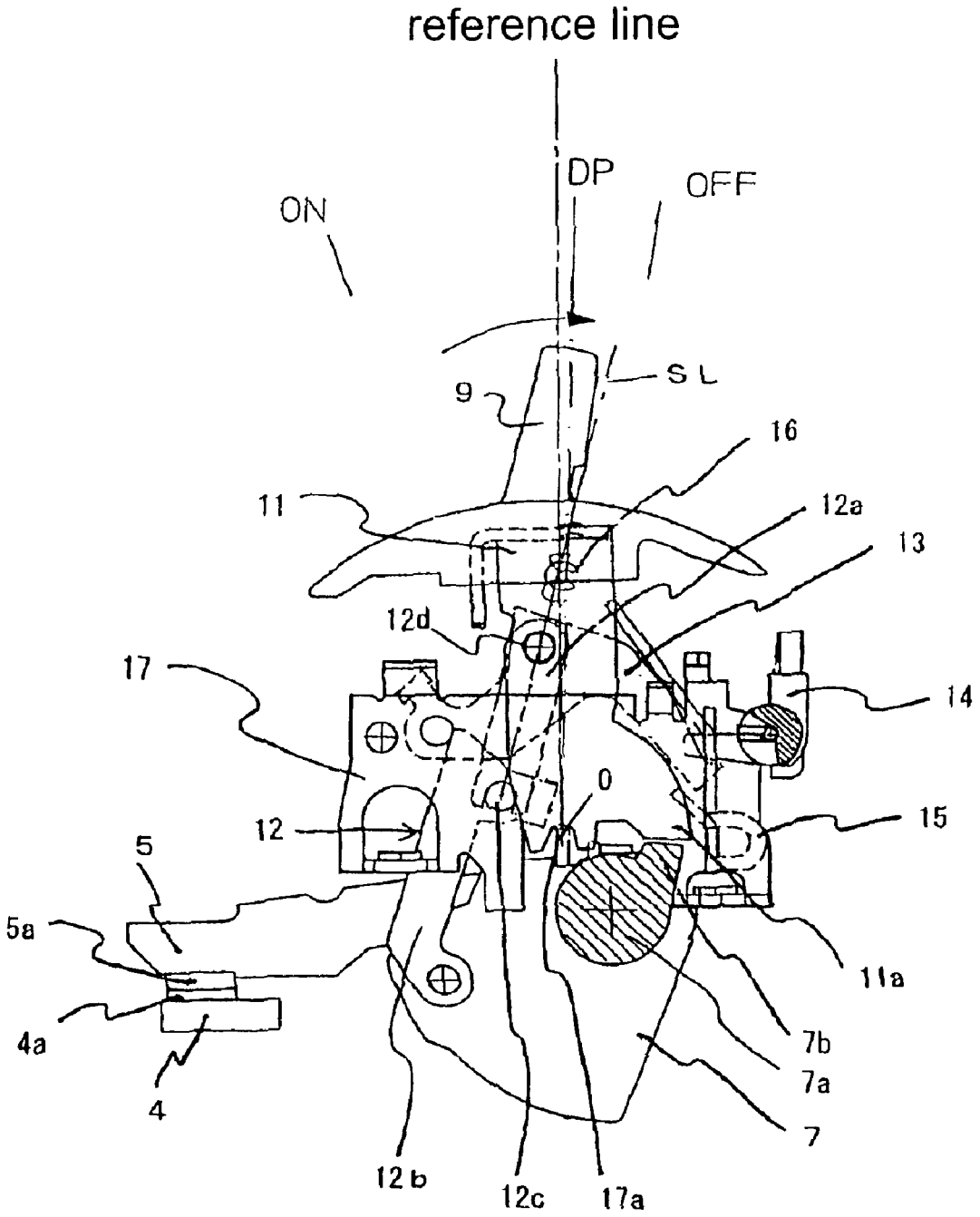
Fig. 7 Prior Art
FIG. 7 is a side view showing a conventional switching device having an isolation function in a state that a handle is prevented from moving corresponding to FIG. 4.

A circuit breaker has a switching device 8 having a basic structure similar to a conventional circuit breaker shown in FIG. 7. The circuit breaker includes abutting stoppers or first stoppers 7*b*, 11*a* formed on a contact holder 7 and a handle lever 11, respectively, as means for preventing an operation handle 9 from moving to an "off" position when contact points are stuck. In addition to a configuration of the conventional circuit breaker, the circuit breaker of the invention further includes side plates 17 having second stoppers 17*b* facing rear edges of the handle lever 11 (toward the "off" position of the operation handle). The second stopper 17*b* is a protrusion formed on an outer surface of the side plate 17, and faces an edge surface of a circular arc member formed on a rear edge of the handle lever. The circular arc member has a radius of curvature of the handle lever 11 relative to a rotational center O.

A dog 11*b* extends from a front edge of a base of the handle lever 11 toward the toggle linkage, and a dog-receiving member 12*b*-1 extends upward from a lower toggle link 12*b* of a toggle linkage 12 to face the dog 11*b*.

Figure 2:
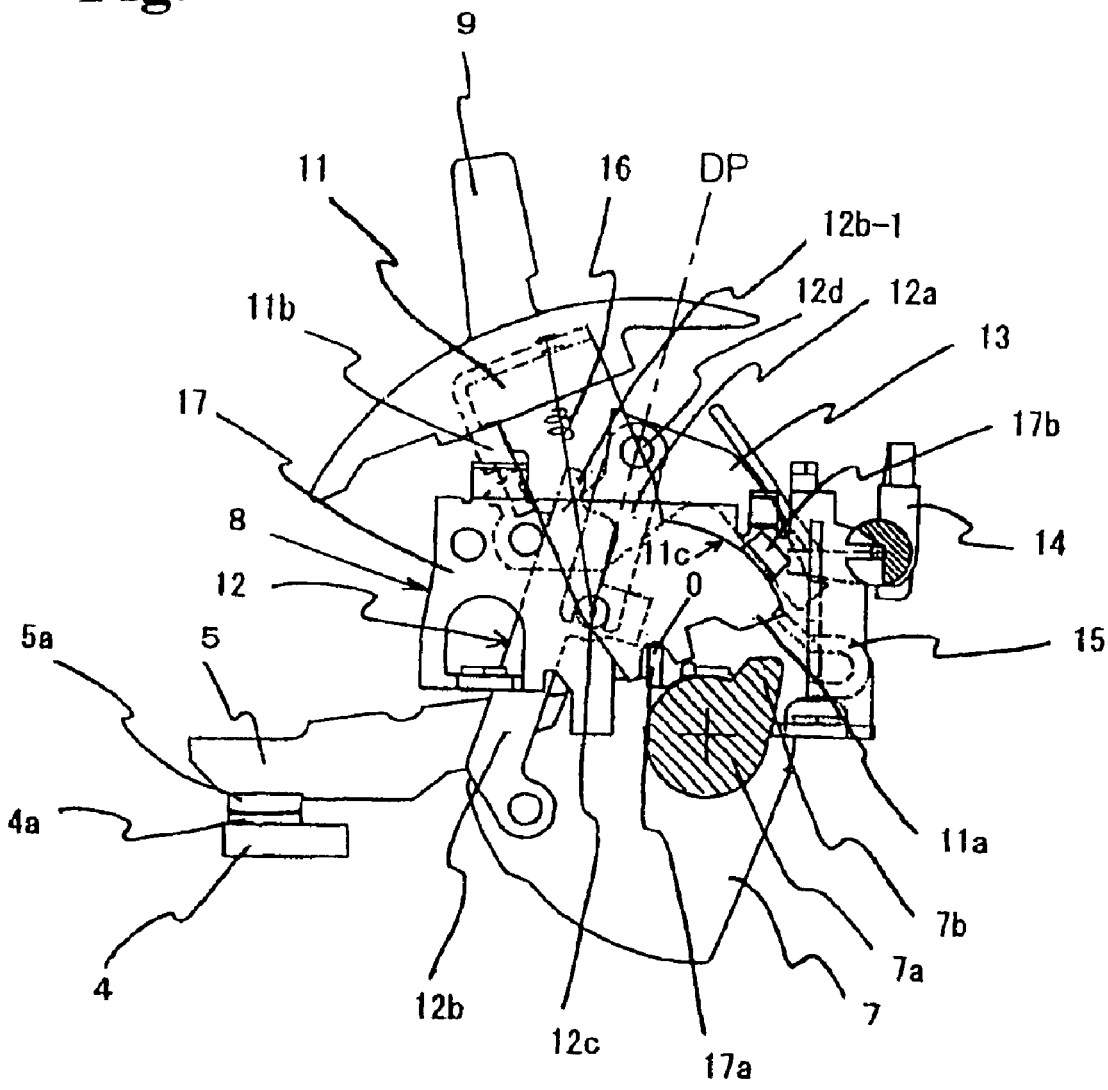
FIG. 2 is a side view showing a portion of the switching device shown in FIG. 1 corresponding to one phase in an "on" state.

In the configuration described above, when the contact points are open ("on" state) as shown in FIG. 2, an upper toggle link 12*a* and the lower toggle link 12*b* of the toggle linkage 12 are aligned linearly. The dog-receiving member 12*b*-1 extending upward from the lower toggle link 12*b* is separated from the dog 11*b* formed on the upper base of the handle lever 11. An action line of a switching spring 16 is located on the left side ("on" position side) relative to a dead point DP of the toggle linkage 12 (on a line between connecting pins 12*c*, 12*d*).

Figure 3:
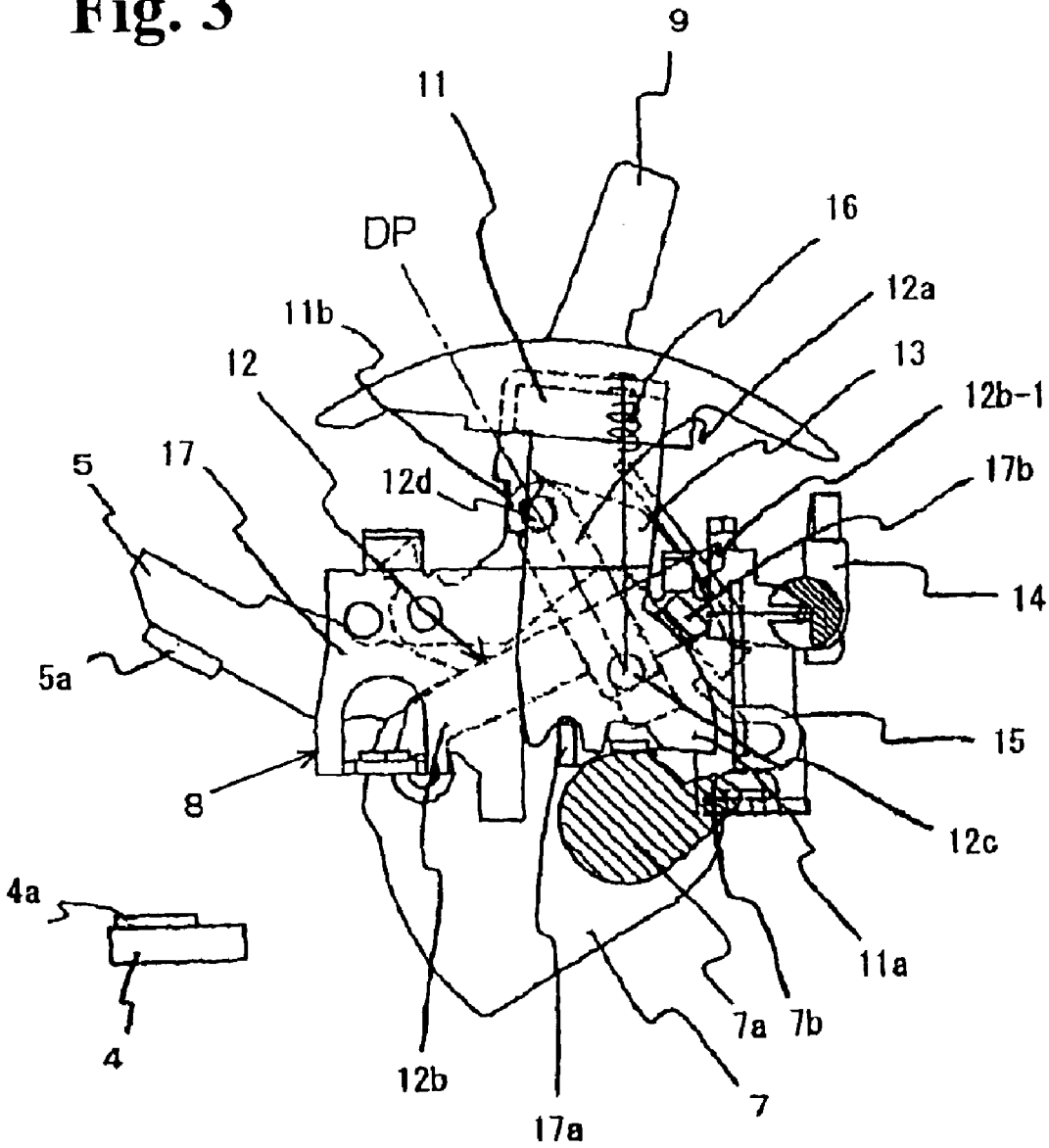
FIG. 3 is a side view showing the switching device in an "off" state in a state that contact points are not stuck.

FIG. 3 shows a state in which the operation handle 9 is moved to the "off" position, and the contact points are opened ("off" state) . In this state, the toggle linkage 12 is folded into a shape of the symbol "<" , and the action line of the switching spring 16 is located on the right side ("off"-position side) relative to the dead point DP. Incidentally, in a normal state in which the contact points are not stuck together, when the operator moves the operation handle 9 to the "on" or "off" position, the handle lever 11 and the contact holder 7 are both rotated in the same direction. Accordingly, the abutting stopper 11*a* of the handle lever 11 does not abut against the abutting stopper 7*b* of the contact holder 7. Further, the second stopper 17*b* faces an end face 11*c* of the circular arc member of the handle lever 11 around the rotational center O, so that the stopper 17*b* does not block the operation handle 9.

Figure 4:
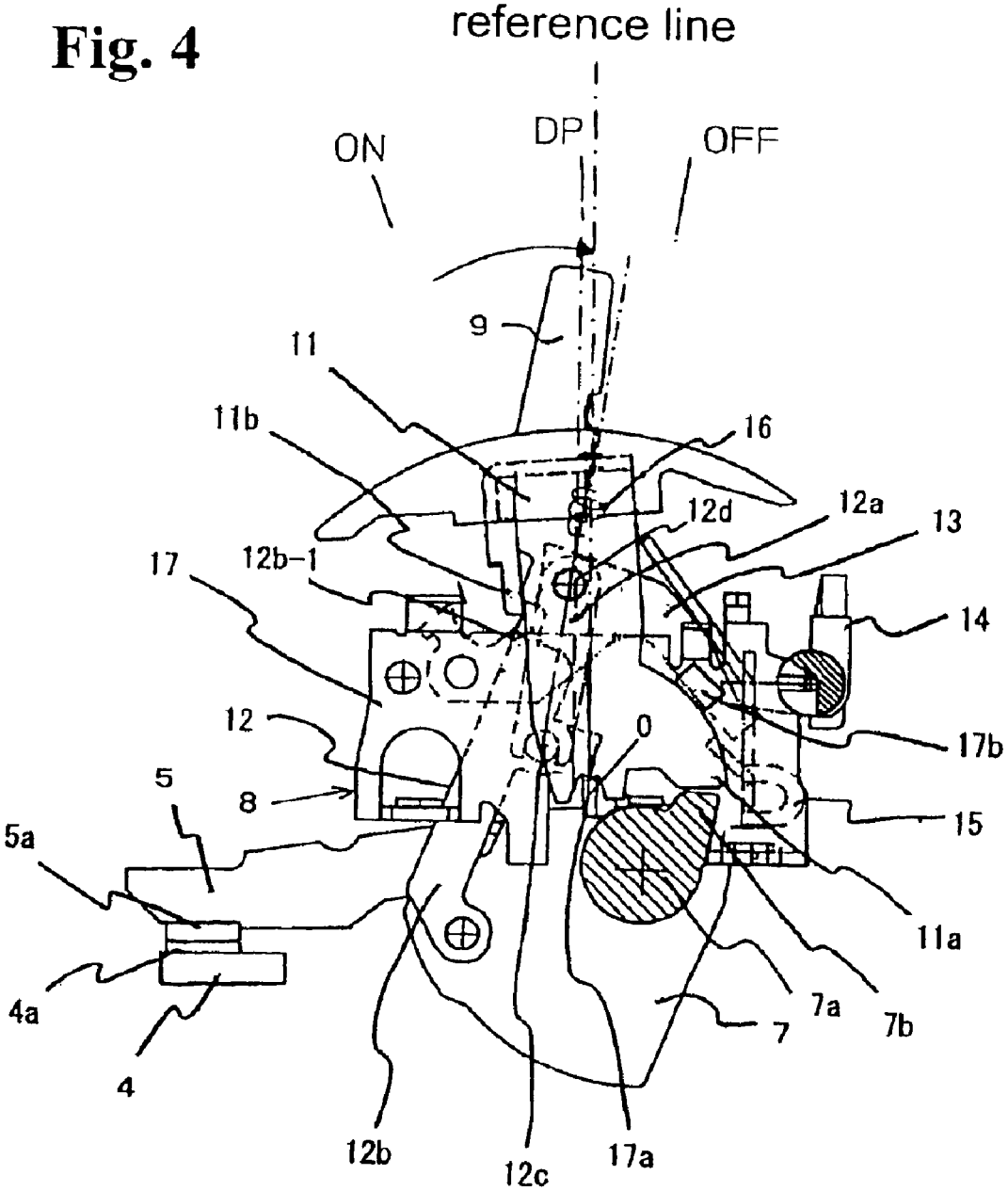
FIG. 4 is a side view showing the switching device in a state that an operation handle is moved to the dead-point position during a process of moving from the "on" position to the "off" position while the contact points are stuck.
Figure 5:
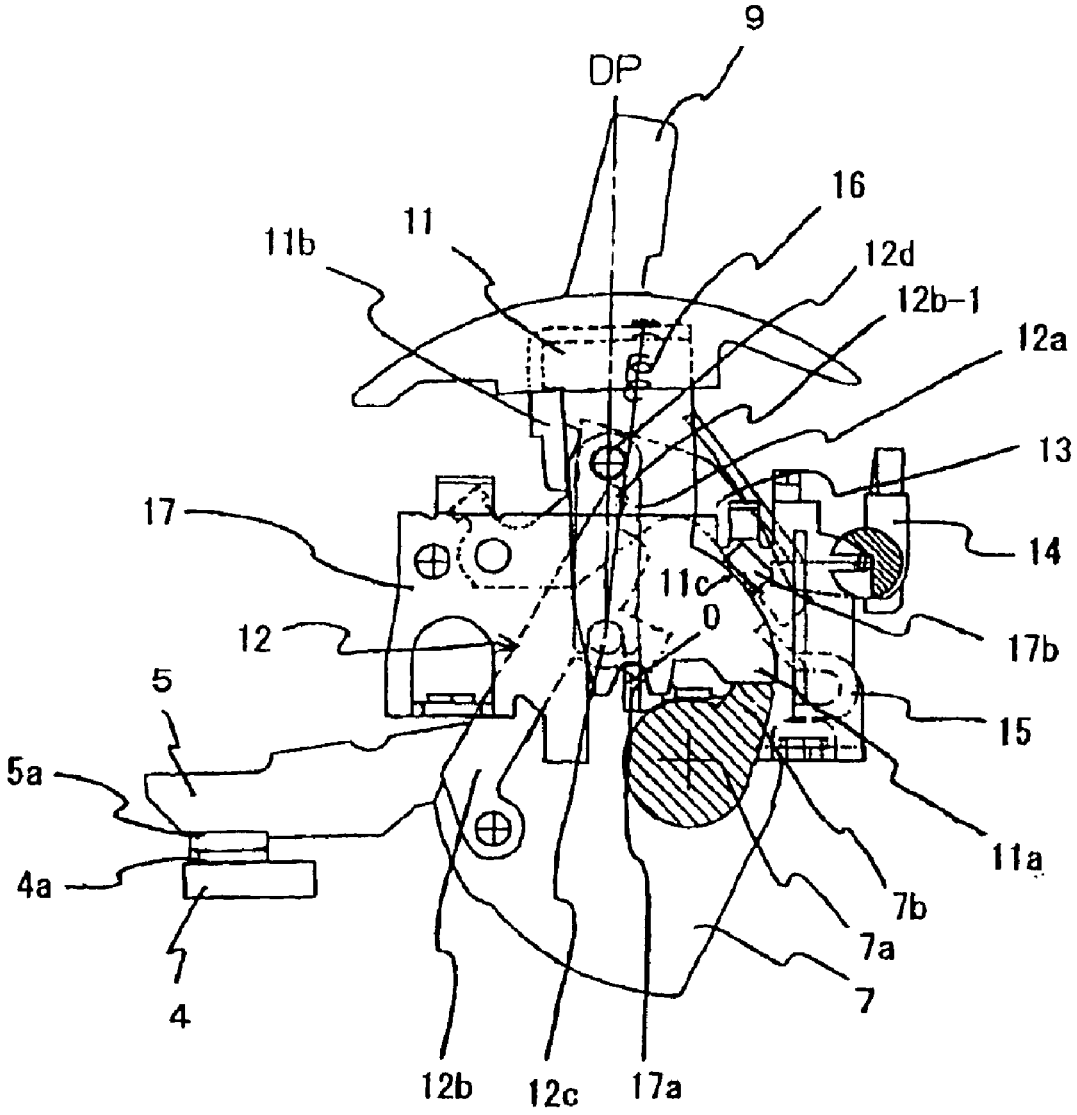
FIG. 5 is a side view of the switching device in a state that the operation handle passes a dead-point position shown in FIG. 4, and abutting stoppers abut against each other to prevent the operation handle from moving.
Figure 6:
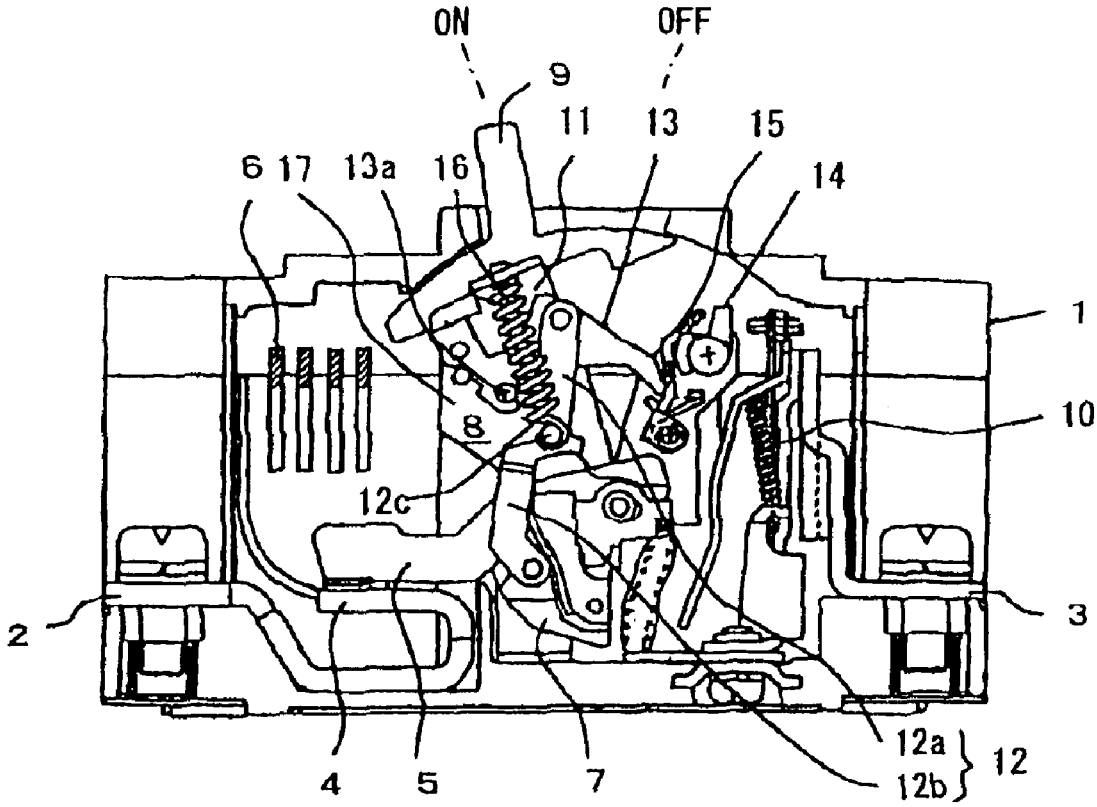
Fig. 6 Prior Art
FIG. 6 is a sectional view of a basic structure of the circuit breaker.

An operation of the operation handle 9 from the "on" position to the "off" position in a state that the contact points are stuck together will be described next with reference to FIG. 4 and FIG. 5. When the operation handle 9 moves from the "on" position, in a course of the movement, the dog 11*b* of the handle lever 11 abuts against the dog-receiving member 12*b*-1 extending upward from the lower toggle link 12*b* of the toggle linkage 12, and pushes the dog-receiving member 12*b*-1 to the right side. As a result, as shown in FIG. 4, the connecting pin 12*c* between the lower toggle link 12*b* and the upper toggle link 12*a* moves to the right side. Also, the upper toggle link 12*a* turns to a vertical position, and the dead-point position DP of the operation handle 9 moves to a position closer to the "on"-position side (left side of a reference line of the switching device).

Note that in the conventional structure shown in FIG. 7, the dead-point position DP of the operation handle is located on the right side of the reference line closer to the "off"-position side. When the operation handle 9 moves to the position shown in FIG. 5 beyond the dead point shown in FIG. 4, the abutting stopper 11*a* of the handle lever 11 abuts against the abutting stopper 7*b* of the contact holder 7, thereby preventing the operation handle 9 from moving.

As described above, in the embodiment of the invention, the dog 11*b* and the dog-receiving member 12*b*-1 are provided on the handle lever 11 and the lower toggle link 12*b*, respectively. Accordingly, when the operation handle 9 moves from the "on" position to the "off" position, the connecting pin 12*c* of the toggle linkage 12 is moved to the right side, and the dead-point position DP is forcibly changed to a position closer to the "on" position. Therefore, it is possible to securely obtain an isolation function without an influence of a structure of the switching device or an assembly variation.

In the conventional structure shown in FIG. 7, when the operator tries to move the operation handle 9 from the locked state to the "off" position with a large force, the handle lever 11 rotates clockwise around an abutting point between the abutting stoppers 11*a*, 7*b* (the handle lever 11 comes out from the bearing part 17*a* of the side plate 17), and the operation handle 9 moves to the "off" position.

In contrast, in the embodiment of the invention, when the operator tries to move the handle lever 11 clockwise around the abutting point of the abutting stoppers, the second stopper 17*b* abuts against the side edge of the handle lever 11, thereby preventing the handle lever 11 from moving.

Accordingly, it is possible to securely prevent the operation handle 9 from moving to the "off" position.

In the embodiment of the invention, the abutting stoppers 11*a*, 7*b* and the second stopper 17*b* are provided as the means for preventing the operation handle 9 from moving to the "off" position when the contact points are stuck together. Further, the dog 11*b* formed on the handle lever 11 and the dog-receiving member 12*b*-1 extending from the lower toggle link 12*b* are provided as the means for shifting the dead-point position DP to a position closer to the "on" position when the operation handle 9 is moved from the "on" position to the "off" position. When the switching device 8 has a structure in which the "off" position of the operation handle 9 is separated sufficiently from the dead-point position DP, the dog 11*b* and the dog-receiving member 12*b*-1 can be omitted.

As described above, the switching device of the invention includes the handle lever connected to the operation handle and having the end portion as the rotational center thereof; the toggle linkage having the upper toggle link and the lower toggle link and disposed between the contact holder and the latch of the tripping mechanism; the switching spring placed between the handle lever and the arm connecting point of the toggle linkage; and the side plates for holding the components. The circuit breaker further includes; first stoppers formed on a cross bar of the contact holder and the handle lever facing the cross bar; and the second stopper for preventing the handle lever from moving around the abutting point of the stoppers to the "off" position as the means for preventing the operation handle from moving to the "off" position when the main-circuit contact points are stuck.

In the present invention, when the operation handle is moved to the "off" position while the contact points are stuck, the second stopper prevents the operation handle from moving to the "off" position around the abutting point of the first stoppers, thereby increasing the reliability of the isolation function.

Further, in the present invention, when the operation handle is moved from the "on" position to the "off" position, the dead-point position is forcibly moved to the position closer to the "on" position, so that the circuit breaker can stably perform the isolation function without an influence of a structure of the switching device or an assembly variation.

While the invention has been explained with reference to the specific embodiments of the invention, the explanation is illustrative and the invention is limited only by the appended claims.

What is claimed is:

1. A circuit breaker comprising:

a fixed contact, a rotatable contact, a contact holder supporting the rotatable contact, an operation handle moving between an ON position and an OFF position for opening and closing the rotatable contact, an over-current tripping device for performing a tripping operation in response to an over-current and having a latch, a switching device including a handle lever connected to the operation handle and having a support point at an end thereof; a toggle linkage interposed between the contact holder and the latch and having a connecting pin, and upper and lower links connected by the connecting pin; a spring disposed between the handle lever and the connecting pin; and a side plate for supporting the handle lever, the toggle linkage and the spring, and means for preventing the operation handle from moving to the OFF position when the movable contact is stuck to the fixed contact, said means including first stoppers formed on a cross bar of the contact holder and the handle lever facing the cross bar, respectively, and a second stopper formed on the side plate of the switching device for preventing a movement of the operation handle to the OFF position.

2. A circuit breaker according to claim 1, wherein said second stopper is a protrusion provided on the side plate of the switching device so as to face a rear edge of the handle lever of the switching device relative to a center of swinging of the handle lever.

3. A circuit breaker according to claim 1, further comprising a dog formed on the handle lever and extending toward the toggle linkage and a dog-receiving member extending from the lower link of the toggle linkage so that when the movable contact is stuck to the fixed contact and the handle lever is moved from the ON position to the OFF position, the dog pushes the dog-receiving member to move the connecting pin of the switching device to a position closer to the ON position of the operation handle.

* * * * *